US009408441B2

(12) United States Patent
McGlynn

(10) Patent No.: US 9,408,441 B2
(45) Date of Patent: Aug. 9, 2016

(54) SEAT BELT SAFETY DEVICE

(71) Applicant: William McGlynn, Farmingdale, NY (US)

(72) Inventor: William McGlynn, Farmingdale, NY (US)

( * ) Notice: Subject to any disclaimer, the term of this patent is extended or adjusted under 35 U.S.C. 154(b) by 85 days.

(21) Appl. No.: 14/222,906

(22) Filed: Mar. 24, 2014

(65) Prior Publication Data

US 2014/0208549 A1 Jul. 31, 2014

Related U.S. Application Data

(63) Continuation-in-part of application No. 13/751,337, filed on Jan. 28, 2013, now Pat. No. 8,677,577.

(51) Int. Cl.
*A44B 11/25* (2006.01)

(52) U.S. Cl.
CPC ..... *A44B 11/2576* (2013.01); *Y10T 24/45623* (2015.01)

(58) Field of Classification Search
CPC ..... A44B 11/2576; A44B 11/2573; A44B 11/2569; Y10T 24/45623
See application file for complete search history.

(56) References Cited

U.S. PATENT DOCUMENTS

| | | | | |
|---|---|---|---|---|
| 5,307,544 A * | 5/1994 | Quarberg | ..... | A44B 11/2576 24/579.11 |
| 2006/0196020 A1* | 9/2006 | Symns | ..... | A44B 11/2573 24/633 |
| 2007/0101558 A1* | 5/2007 | Marinkovic | ..... | A44B 11/2573 24/633 |

* cited by examiner

*Primary Examiner* — Abigail Morrell
(74) *Attorney, Agent, or Firm* — John F. Vodopia

(57) ABSTRACT

A seat belt safety device prevents access to a release button located on a surface of a seat belt housing attached to a first seat belt segment, the housing surface also including a housing opening through which a seat belt tongue attached to a second seat belt segment is inserted to securely latch the first seat belt segment to the seat belt housing and the second seat belt segment. The seat belt safety device includes a blocking assembly formed as a cylindrical standoff with an inner channel within which a rod with a release handle at one end and a blocking member at its other end is arranged for axial movement when the blocking assembly is not in a locked state and a spring. The release handle is grasped to extend the rod against a force of the spring to press the release button of the seat belt housing.

14 Claims, 11 Drawing Sheets

SEAT BELT SAFETY DEVICE

CROSS-REFERENCE TO RELATED APPLICATION

This application is a continuation-in-part application of U.S. patent application Ser. No. 13/751,337, filed on Jan. 28, 2013 ("the parent application"), which parent application is a continuation/divisional application of U.S. patent application Ser. No. 12/806,563, filed on Aug. 16, 2010 and issued as U.S. Pat. No. 8,393,061 on Mar. 12, 2013 ("the grandparent application"). This application and claims priority from the parent application under 35 USC §120.

BACKGROUND OF THE INVENTION

The present invention broadly relates to seat belt safety and, more particularly relates to a safety device that is used with a conventional seat belt apparatus to prevent small children or persons with impaired cognitive ability from accessing a push button release to unlock the seat belt.

Known automobile seat belts include a latch housing fixed to one seat belt segment, and a latch tongue fixed to the other seat belt segments. The latch tongue typically includes a latching aperture through which a locking element passes. During operation, a passenger is seated, the two belt segments are brought together to surround the seated passenger and the latch tongue is inserted into the latch housing. The insertion causes a locking member to extend into and become fixed within the latching aperture, securely connecting the two seat belt segments thereby securing the passenger in the seat.

To release and unfasten the locked seat belt, i.e., disengage the latch; a spring loaded release button is included in the buckle (latch) housing. The latch release button is located either on the side of the housing into which the tongue is inserted, or located on a horizontal housing surface that is substantially parallel to the insertion direction. Upon actuating the release button through application of a sufficient force, the locking member is extracted from the tongue aperture thereby releasing the latch. Releasing the latch allows for the tongue to disengage from the buckle housing, thereby separating the seat belt segments to release the passenger.

While the seat belt release button access is convenient for adult passengers, it may be dangerous for small children thought to be safely secured after latching, typically by an adult parent or guardian. That is, small children learn very soon the function of the seat belt release button and have the ability, at a very early age, to depress the release button and release them from the seat belt. Doing so not only puts them at a safety risk in case of a collision, but also allows them to stand up or climb throughout the automobile cabin. For matter, cognitively impaired older children and adults also may release seat belts or other safety harnesses employing push button release buckle holding mechanisms at inappropriate times.

In order to overcome this problem, various seat belt safety devices are known that attempt to prevent or limit access to seat belt buckle release buttons.

For example, U.S. Pat. No. 4,502,194 (the '194 patent) discloses a child proof automobile seat belt. The seat belt includes a latch tongue with a latching aperture fixed to one seat belt segment and a latch housing fixed to the other seat belt segment. The latch housing has a recess and opening at its distal end to receive the latch tongue, which tongue is automatically latched within the housing by insertion. The tongue is released by depressing a release button through an opening in the top face of the latch housing. A safety cover sleeve designed to be slipped over the latch housing is configured with one end partially closed to pass the latch tongue and with a small opening that overlies the release button.

The sleeve is retained in enclosing position on the housing by the latch tongue, whereafter a key or other tool can be inserted into the hole to press and release the button. But while the inventive sleeve does limit access, it appears to be intended for operation with side located release button. Also, the sleeve is designed as a second housing, which is cumbersome, and bulky, and tends to slip up the belt on the tongue side.

U.S. Pat. No. 4,987,662 (the '662 patent) discloses a seat belt release guard for use with a seat belt assembly in which the seat belt includes a latch plate on one free seat belt end and a latch, plate receiving buckle assembly on the other free seat belt end. The latch plate receiving buckle assembly includes a spring release member thereon. The release guard comprises a buckle assembly receiving component and a cover component hingedly secured to adjacent one end of the receiving component and moveable in an arc parallel to the longitudinal axis of the release guard, from an open, unguarded buckle release position to a closed, guarded position detachably covering the associated spring release member against inadvertent access.

The release guard further comprises means to detachably latch the cover component to the receiving component when in the closed position, means to selectively release the cover component from the release component to move the cover component to the open unguarded position and means to detachably secure the release guard to the associated buckle assembly. But like the '194 patent, the '662 patent hinged cover is cumbersome, and bulky, as it completely covers the seat belt mechanism.

U.S. Pat. No. 6,988,297 (the '297 patent) discloses a security cover for a belt-type passive restraint system. The security cover includes a buckle with a tab selectively received in a tab receiver. The tab receiver includes a release button for releasing the tab whereby the passive restraint system is opened. The security cover includes a slot for receiving the tab and a keyhole located thereover for passing a key to the release button for releasing same. The keyhole is generally aligned with the release button with said receiver positioned in the enclosure, and a retainer selectively connected to the cover and to one of the receiver and the second belt. The retainer selectively retains the receiver within the cover enclosure. An optional restraint assembly can be provided for retaining the security cover on the belt receiver. In any of the embodiments, the housing is cumbersome, and bulky, and being that connections must be made with the housing, the guard is difficult to use.

U.S. Pat. No. 5,307,544 (the '544 patent) discloses a seat belt buckle guard comprising a one-piece, molded plastic, box-like enclosure. The enclosure includes one open end and an opposite end wall with a slot. A seat belt buckle fits through the open end into the enclosure and includes a latch plate receiving slot aligned with the slot in the housing. The latch plate on one belt half is inserted through the housing slot to mate with the buckle. An opening is formed in the top wall and the end wall for gaining access to the buckle release button. In one arrangement, the opening is a narrow slot through which a flat object, such as a key, can be inserted to operate the buckle's release button.

Alternatively, the opening is a circular aperture of a size permitting one's finger to be inserted to operate the release button. That is, the opening is surrounded by a tubular stub or neck that is threaded on its exterior to receive a child-resistant safety cap of the type commonly used on medicine bottles.

When the cap is removed, exposing the opening, a finger can be inserted to activate the release button. Alternatively, the unit can be separated by folding along the hinge to allow actuation of a lever-type release or to gain access to a release button disposed on a front end edge of the buckle receptacle. In any of the embodiments, the housing is cumbersome, and bulky, and being that connections must be made with the housing, the guard is difficult to use.

SUMMARY OF THE INVENTION

The present invention provides a simple mechanical device that when used in cooperation with a conventional seat belt locking mechanism, prevents a child or mentally challenged adult from being able to access the push button on the mechanism housing to unlock the locked seat belt.

In one embodiment, the invention includes an L-shaped seat belt safety device configured to prevent access to a release button located on an upper surface of a seat belt housing that is attached to a first seat belt segment, the seat belt housing including a housing side with a housing slot for receiving a tongue latch affixed to a second seat belt segment, wherein the tongue latch is inserted in the housing slot to securely latch the first seat belt segment to the second seat belt segment.

The L-shaped seat belt safety device comprises a first substantially planar member including a slot opening for receiving the tongue latch of the second seat belt segment, a second substantially planar member attached to at least one edge of the first substantially planar member to form the L shape and to extend at about 90° from a point of attachment so that when the tongue latch is inserted through the slot opening into the housing slot to latch, the second substantially planar member contacts the seat belt housing to lie substantially flat against a portion of an outer surface of the seat belt housing such that the seat belt safety device is substantially immobilized.

The second substantially planar member includes a limited access opening, substantially centered and proximate the release button in the upper surface of the seat belt housing so that when the tongue latch is inserted through the slot opening into the housing slot to latch and secure the first seat belt segment with the second seat belt segment, and wherein the limited access opening provides limited access to the release button to unlatch the first seat belt segment from the second seat belt segment.

A release actuator mechanism is mounted on the second substantially planar member at the limited access opening comprising a rotating member and an extending member attached to the rotating member that is configured to advance, extending through the access opening, when the rotating member is squeezed to overcome a locked position of a detent element and rotated about a central axis as it is pressed down towards the upper surface of the substantially planar member to contact the release mechanism, and retracts back to a start position automatically when the release mechanism is released.

The rotating member comprises a spring to effect spring loaded operation of the release actuator mechanism. The detent element is positioned on an inner surface of the rotating member and wherein the rotating member is formed of a compressible material that when squeezed, causes the detent element to be released from the locked position where it normally resides in an arrested movement state, thereby allowing rotational movement of the rotating member along a fixed track both radially and axially downwards and consequential extension of the extending member through the limited access opening to actuate the release button.

In an embodiment, the invention provides a seat belt safety device for preventing access to a release button located on a surface of a seat belt housing attached to a first seat belt segment, the housing surface also including a housing opening through which a seat belt tongue attached to a second seat belt segment is inserted to securely latch the first seat belt segment to the seat belt housing and the second seat belt segment.

The seat belt safety device comprises a metal sheet configured with a first substantially planar part, a second substantially planar part extending perpendicularly from a full bend at one end of the first substantially planar part, left and right substantially planar parts extending perpendicularly from bends at respective left and right ends of the first substantially planar part and a longitudinal slot extending for part of a distance between the left and right substantially planar parts substantially in parallel with a line of the full bend. A blocking assembly comprising a cylindrical standoff extends perpendicularly from an outer surface of the first substantially planar part proximate the longitudinal slot and is configured with an inner channel defined by a fixed radius and extending an entire axial length of the cylindrical standoff. A rod with a release handle at one end and a blocking member at its other end is arranged for axial movement when the blocking assembly is not in a locked state. The blocking assembly also includes a spring.

The first substantially planar part includes a though-hole in communication with the inner channel of the cylindrical standoff. The rod is formed with a channel portion moveably positioned within the inner channel and an extension portion extending between an end of the cylindrical standoff and the handle and which is surrounded by the spring, when the blocking assembly is in a locked state. One end of the spring butts up against a disc-shaped surface of the cylindrical standoff and another end of the spring butts up against a lower cylindrical end of the handle. Applying a pushing force at the handle causes the channel portion and blocking member to extend away from the inner surface of the first substantially planar member against a return force of the spring. Releasing the pushing force allows the spring to return the extended channel portion and blocking member to the channel position, when the blocking assembly is in an unlocked state.

The inner channel and the rod extension portion are configured to lock the blocking assembly to a locked state and unlock the blocking assembly from a locked state. Preferably, an inner cylindrical surface of the inner channel and a portion of the rod extension portion proximate the blocking member are machined to allow the rod and release handle to turn in one rotational direction at least two complete rotations to axially move to and lock the blocking member against the lower end of the cylindrical standoff and, to turn in another rotational direction at least two complete rotations to unlock and move the blocking member axially away from the lower end of the cylindrical standoff and first substantially planar member.

Upon moving the blocking member away from the lower end of the cylindrical standoff by an axial distance corresponding to at least two axial rotations, the rod and blocking member are free to move axially the remainder of the length of the rod between the lower end of the release handle and the upper cylindrical outer surface of the cylindrical standoff to contact with and depress the actuator bottom of the seat belt housing and release the tongue locked therein. A radial dimension of the blocking member is greater that a radial dimension of the inner channel. Preferably, the blocking assembly is made of metal.

The release handle includes a radial groove within which a slip portion of a flexible plastic handle is slidingly and rotating arranged. The flexible plastic handle operates as a slip clutch. Moreover, the flexible plastic handle comprises a plastic shell that extends up from the slip portion to envelop the release handle, including an inner shell surface proximate but not in contact with an outer gripping surface of the release handle. The flexible plastic handle is configured to be squeezed in order that the inner shell surface engages the outer gripping surface of the release handle to enable a user's hand to apply a rotating force to turn the handle to a release position and operate the seat belt release mechanism.

Preferably, the first and second substantially planar members form an L shape, wherein the right and left substantially planar parts extend for part of an entire width dimension of the first substantially planar member. Most preferably, the first, second, right and left substantially planar parts form a partial enclosure covering the surface of the seat belt housing including the release button. A thickness or depth of the metal sheet is 0.01 and 0.15 inches, preferably 0.0625 inches.

In another embodiment, the invention provides a seat belt safety device for preventing access to a release button located on an upper surface of a seat belt housing attached to a first seat belt segment, the seat belt housing including a side housing surface with an opening through which a seat belt tongue attached to a second seat belt segment is inserted to securely latch the first seat belt segment to the seat belt housing and the second seat belt segment.

The seat belt safety device comprises a metal sheet configured with a first substantially planar part, a second substantially planar part extending perpendicularly from a full bend at one end of the first substantially planar part, left and right substantially planar parts extending perpendicularly from bends at respective left and right ends of the first substantially planar part and a longitudinal slot extending for part of a distance between the left and right substantially planar parts substantially in parallel with a line of the full bend.

A blocking assembly comprising a cylindrical standoff extends perpendicularly from an outer surface of the second substantially planar part and is configured with an inner channel defined by a fixed radius and extending an entire axial length of the cylindrical standoff, a rod with a release handle at one end and a blocking member at its other end arranged for axial movement when the blocking assembly is not in a locked state and, a spring.

The second substantially planar part includes a thoughhole in communication with the inner channel of the cylindrical standoff. The rod is formed with a channel portion moveably positioned within the inner channel and an extension portion extending between an end of the cylindrical standoff and the handle and which is surrounded by the spring, when the blocking assembly is in a locked state. One end of the spring butts up against a disc-shaped surface of the cylindrical standoff and another end of the spring butts up against a lower cylindrical end of the handle and wherein applying a pushing force at the handle causes the channel portion and blocking member to extend away from the inner surface of the second substantially planar member against a return force of the spring. Releasing the pushing force allows the spring to return the extended channel portion and blocking member to the channel position, when the blocking assembly is in an unlocked state.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

The following is a detailed description of example embodiments of the invention depicted in the accompanying drawings. The example embodiments are in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

As mentioned above, the invention comprises a simple mechanical device that when used in cooperation with a conventional seat belt locking mechanism, with a push release button located on either the side or horizontal surface of the latch housing, prevents or limits an ability of a child or cognitively challenged person irrespective of age from being able to access the seat belt push release button in order to unlock the locked seat belt.

Figure 1A:
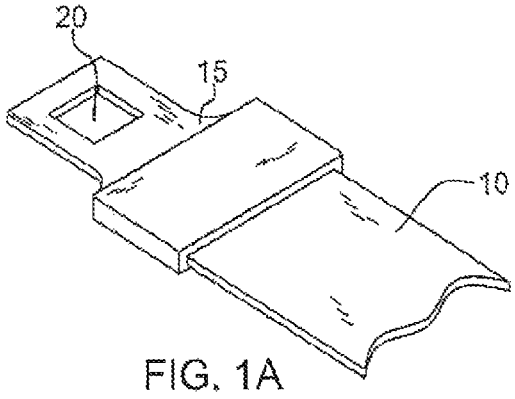
FIG. 1A PRIOR ART
FIG. 1A is a perspective view of a conventional seat belt tongue attached to one end of a seat belt segment.
Figure 1B:
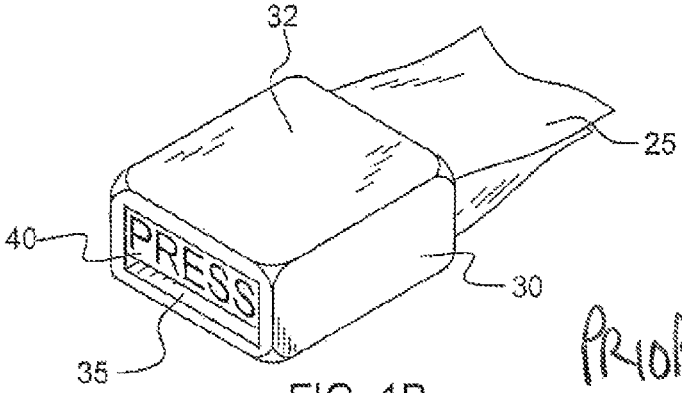
FIG. 1B PRIOR ART
FIG. 1B is a perspective view of a seat belt latch housing attached to one end of a seat belt segment and configured with a seat belt push release button on a housing side proximate a side slot for receiving a seat belt tongue.
Figure 1C:
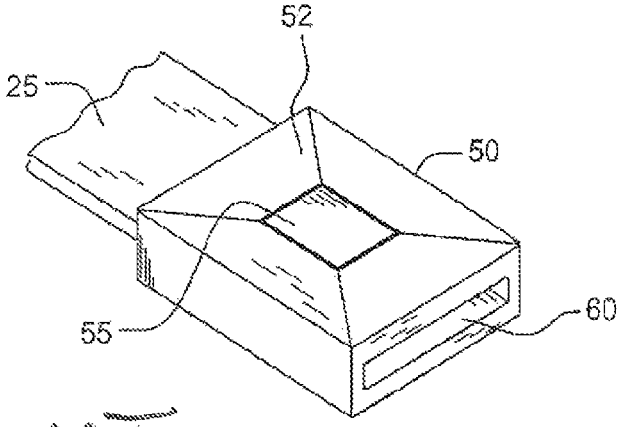
PRIOR ART FIG. 1C
FIG. 1C is a perspective view of a seat belt latch housing attached to one end of a seat belt segment and configured with a seat belt push release button on a housing upper exposed surface, which surface is substantially perpendicular to a side surface that includes a side slot for receiving a seat belt tongue.

FIGS. 1A and 1B together depict a conventional seat belt locking or latching mechanism. That is, FIG. 1A depicts a latch tongue (15) affixed to one seat belt segment (10). Latch tongue (15) includes a latching aperture (20) for receiving a locking element (not shown) that is moved into the aperture when the latch tongue is inserted into the latch housing. FIG. 1B depicts a latch housing (30) fixed to another seat belt segment (25). The latch housing (30) includes a slot (35) or latch opening in a side of the housing opposite a side to which the seat belt element (25) is attached. A release button (40) is shown just above slot (35) that is pressed to release the seat belts from their locked state. FIG. 1C depicts a latch housing (50) fixed to another seat belt segment (25), which includes a slot (60) in a side of the housing opposite a side to which the seat belt element (25) is attached. A release button (55)

is shown on a top surface of latch housing (50), which surface is parallel with the direction of motion for inserting a tongue latch (15) into the slot (60) on the housing side.

During operation, a passenger is seated in an automobile in which other ends of a seat belts segments (10) and (25) are affixed. The two belt segments (10, 25) to which tongue latch (15) and latch housings (30; 50) are attached are brought together to surround the seated passenger and the latch tongue (15) is inserted into the latch housing (30; 50). The insertion causes a locking member (not shown) to extend into and become fixed within the latching aperture (20), securely connecting the two seat belt segments (10; 25), thereby securing the passenger in the seat.

To release and unfasten the locked seat belt, i.e., to disengage the latch tongue (15), the release buttons (40; 55) comprise a spring loaded release mechanism in the respective latch housings (but not shown in the drawing figures). Upon actuating the release button (40; 55) through application of a sufficient pressing force, typically applied directly by a user's fingers, the locking member is extracted from the tongue aperture (20), thereby releasing the latch tongue (15) from its position in the housing (30; 50). The invention prevents or limits an ability of small children or individuals that may be cognitively impaired or otherwise challenged from readily accessing or otherwise actuating the release buttons (40, 55) and unlock or separate the complementary seat belt segments.

Figure 2B:
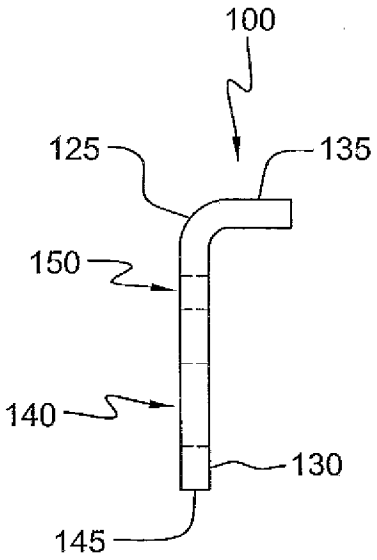
FIG. 2B is side plan view of the FIG. 2A embodiment.
Figure 2A:
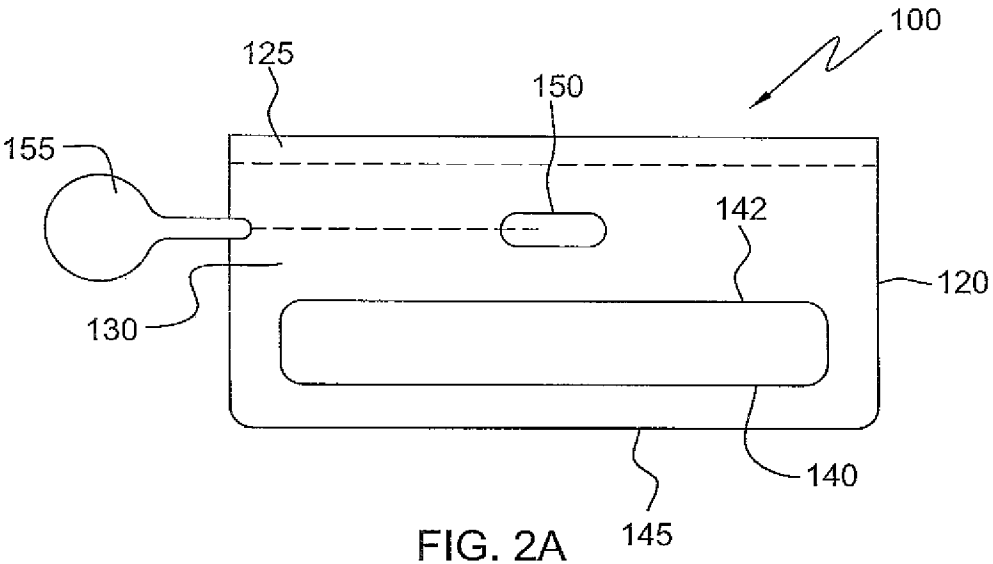
FIG. 2A is a top plan view of one embodiment of the seat belt safety device configured for operation with a seat belt latch housing depicted in FIG. 1B.

FIG. 2A shows a top plan view of one embodiment of the seat belt safety device (100) of the invention. FIG. 2B is a side view of the FIG. 2A seat belt safety device (100). As shown, seat belt safety device (100) comprises two substantially perpendicular planar members (130; 135). While the planar members may be formed as separate members, and joined, it is preferred that the device is configured from a 2"×3" single piece (or plate) of sheet-like material (120). The sheet-like plate may be molded, extruded or punched out of a larger plate or sheet of stainless steel, or other useable material.

The sheet-like material comprising plate (120) may be metal, hard plastic or like material, wood, etc., but is preferably stainless steel. The thickness may be varied in a range of between 1/64" and 1/4", but is preferably 1/16". Please note that the particular dimensions of the plate (120) are provided for exemplary purposes only, and may be varied to accommodate the dimensions of various seat belt locking mechanisms without deviating from the scope and spirit of the invention.

When formed from a single plate of sheet-like material, one longitudinal edge of the plate (120) is bent at a substantially 90° angle to form a first planar section (130) and a second planar section (135), separated by a bend or mutual edge (125). The first planar section (130) is about 2 1/4"×3;" the second planar section is about 3/8"×3". The bend or edge (125) extends for the entire 3" length. Please note that while the safety device (100) depicted in FIGS. 2A; 2B is formed of one solid sheet-like metal (2"×3") plate (120), for example, stainless steel, the invention is not limited thereto. The invention may be formed of any hardened shape-retaining material. For that matter, the invention includes that the first planar section (130) and second planar section (135) may be formed as separate flat pieces connected or attached by various means, i.e., welding.

A horizontal slot (140) is included in the first planar section (130), which is approximately 1/2" off an edge (145) that is opposite to the bend (125). The slot (140) is approximately 1/8" to 1/4" wide, but preferably 3/16". The slot (140) extends about 1 5/8" of the 3" length in parallel with edge (145) and the bend (125). The slot is preferably centered. In from an inner edge (142) of the slot (140) about 1/4" is an access opening (150) used to provide access to pressing means (155) for pressing a seat belt push button release (as described above).

Pressing means (155) may comprise without limitation a key, pin, screw driver, pen, pencil, etc. Access opening (150) is a hole or via in the first planar section (130) that is about 1/16" to 1/2" long and 1/16" to 1/4" wide, and preferably 3/8" long by 3/16" wide. Please note however, the specific dimensions disclosed are for exemplary purposes only, and are not meant to limit the invention in any way. The access opening may comprise any known shape, for example, instead of rectangular, it may be circular with a radius of between 1/16" and 3/8", and preferably 1/4". The size of access opening (150) only matters in that it must be large enough to allow insertion of the means for pressing (155) to actuate release by pressing seat belt release button (35), but not too large that a child or cognitively challenged person might be able to extend their finger in to actuate.

Figure 2C:
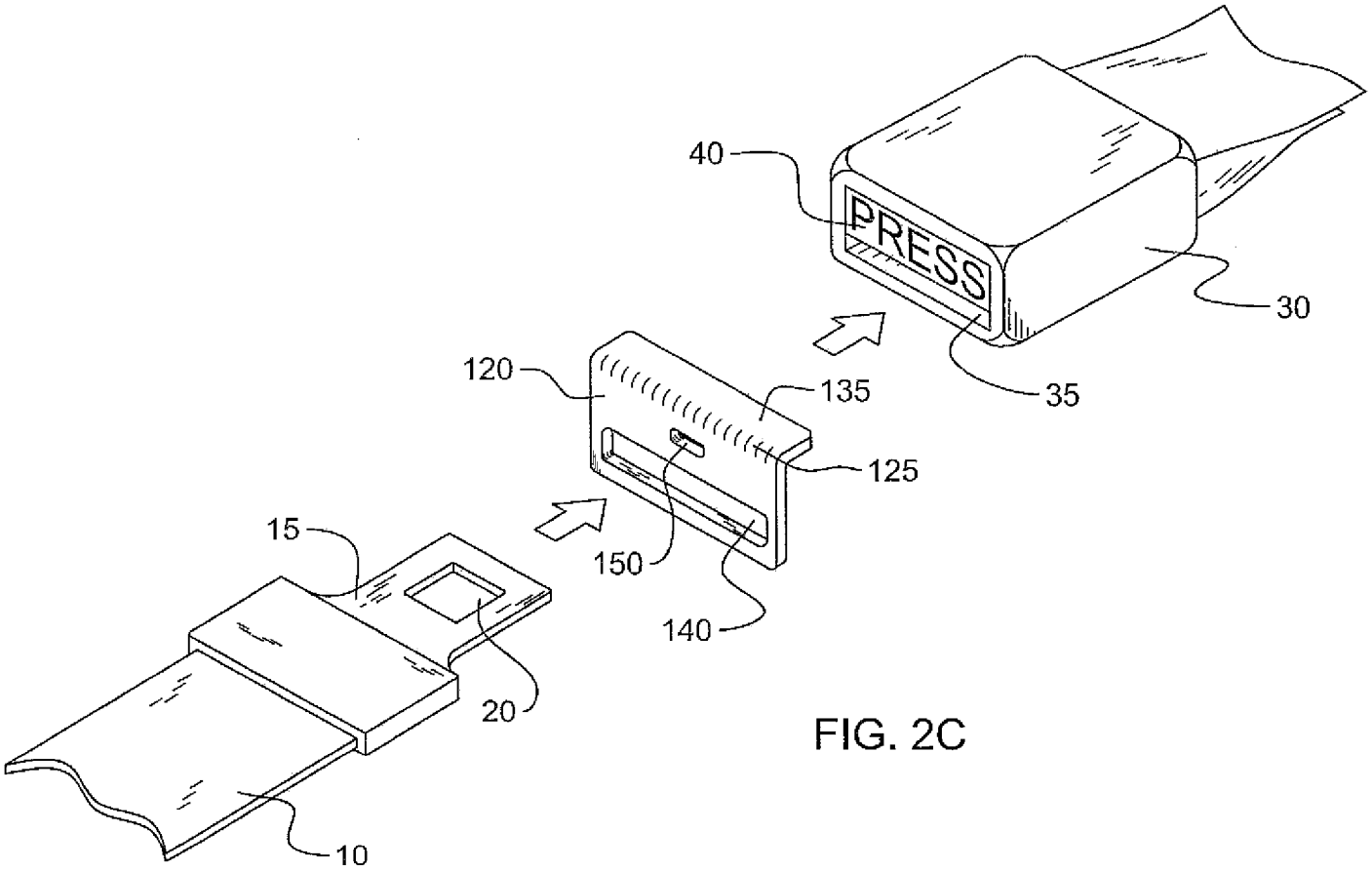
FIG. 2C is a perspective view of the seat belt safety device (100) of FIGS. 2A and 2B interposed between a seat belt tongue (15) and seat belt latch housing (30) in an exploded view to highlight device operation.

FIG. 2C depicts the operation of the seat belt safety device of FIGS. 2A, 2B. That is, the seat belt tongue (15) is inserted through the slot (140) in the first planar surface (130) from which the bend (125) turns forming the second planar surface (135), and then into the latch opening (35) in the locking mechanism housing (30). The orientation of the safety device (100) is such that the opening (150) is located proximate and above the push button release (35) and that an underside of the second planar surface (135) aligns with and contacts a planar or upper horizontal surface (32) of the latch housing (30), as shown.

When latched, there is very little leeway for movement of the safety device (100) off of the upper housing surface (32) and off the underside of first planar surface (130) abutted against the housing side with slot (35). The underside of the first planar surface (130) and the underside of the second planar surface are aligned substantially coplanar with the top or exposed housing surface (32) and side with slot (35). This effectively prevents access to the push button (35), for example, by a finger, other than with pressing means (155) extended through the opening (150).

For that matter, while the flat plate of sheet like material (120) is initially rectangular, so that when bent the first and second planar sections also are rectangular, the safety device (100) is not limited to a particular shape as long as it comprises two substantially flat surfaces to accommodate a access slot and access opening, and when arranged against a latch housing extending through the slot and latched, is substantially immobile preventing finger access to the access opening.

Figure 3B:
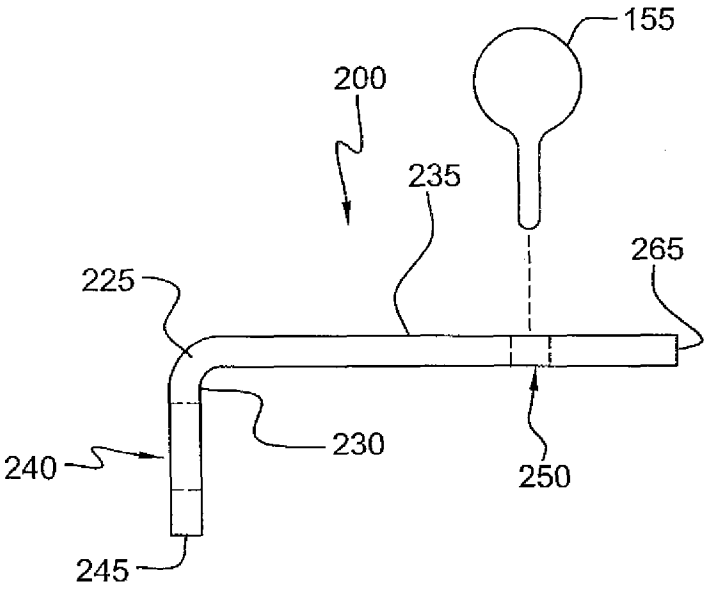
FIG. 3B is side plan view of the FIG. 3A embodiment.
Figure 3A:
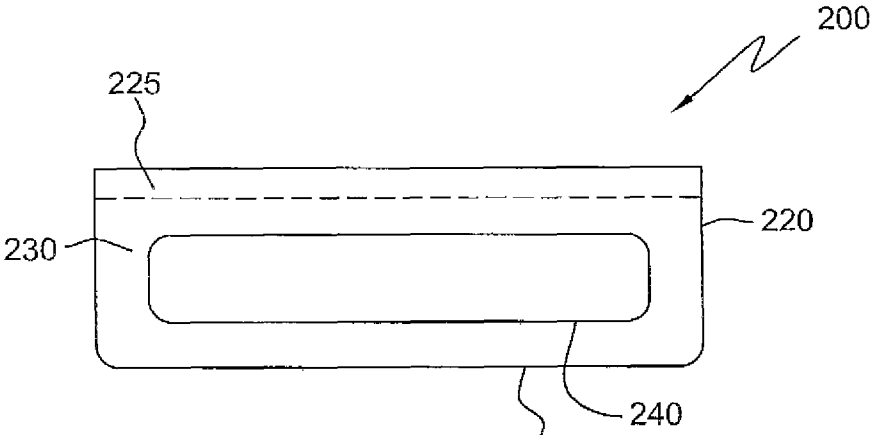
FIG. 3A is a top plan view of one embodiment of the seat belt safety device configured for operation with a seat belt latch housing depicted in FIG. 1C.

FIGS. 3A and 3B together depict an alternative embodiment of a seat belt safety device (200) of the invention, which is configured for use with a latch housing (50), as seen in FIG. 1C. FIG. 3A is a top plan view of seat belt safety device (200), and FIG. 3B is a side view. Seat belt safety device (200) may be configured from a 2"×3" piece or plate of sheet-like material (220), and bent, or may comprise two separate pieces joined at a substantially right angle. The material may comprise metal, hard plastic or like material, wood, etc., without limitation, but is preferably stainless steel. Please note that the particular dimensions of the plate (220) are provided for exemplary purposes only, and that its size and/or shape may be varied to accommodate the dimensions of various seat belt locking mechanisms, or the whim of the designer, without deviating from the scope and spirit of the invention.

In the embodiment shown one longitudinal edge (225) of the plate (220) is bent at a substantially 90° angle to form a first planar section (230) and a second planar section (235) at a bend edge (225). The first planar section (230) is about 1¼"×3; the second planar section is about 1⅝×3". The bend edge (225) extends for the entire 3" length. Please note that while the safety device (200) depicted in FIGS. 3A; 3B is formed of one solid plate of sheet-like material (220), the invention is not limited thereto, but may be made of any available solid material. For that matter, the seat belt device may comprise two separate planar sections, first planar section (230) and second planar section (235), which are physically attached and made integral, and the actual dimensions of each of the planar sections may be varied to fit the latch housings for which it will be employed, or the whim of the designer, without deviating from the scope and spirit of the invention.

A horizontal slot (240) is included in the first planar section (230), which is approximately ½" off an edge (245) that is opposite to the bend edge (225). The slot (240) is approximately 1/16" to ¼" wide, but preferably 3/16" wide. The slot (240) extends about 1⅝" of the 3" length in parallel with edge (245) and the bend (225). The slot is preferably centered, and the length is only defined for exemplary purposed; the length, like the slot width, may be increased or decreased to accommodate the width of the tongue latch, or the whim of the designer. Between an outer edge (265) of second planar section (235) and bend edge (225), which is opposite from the outer edge, is an access opening (250) used to provide access to means (155) to be inserted and extend therethrough to press a push button release (55) of seat belt mechanism arranged on the top or upper horizontal surface of latch housing (50).

Access opening (250) is a hole or via in the first planar section (130) that is about 1/16" to ½" long and 1/16" to ¼" wide, and preferably ⅜" long by 3/16" wide. Please note however, the specific dimensions disclosed are for exemplary purposes only, and are not meant to limit the invention in any way. The access opening may comprise any known shape, for example, instead of rectangular, it may be circular with a radius of between 1/16" and ⅜", and preferably ¼". The size of access opening (250) only matters in that it must be large enough to allow insertion of the means for pressing (155) to actuate release by pressing seat belt release button (35), but not too large that a child or cognitively challenged person might be able to extend their finger in to actuate.

Figure 3C:
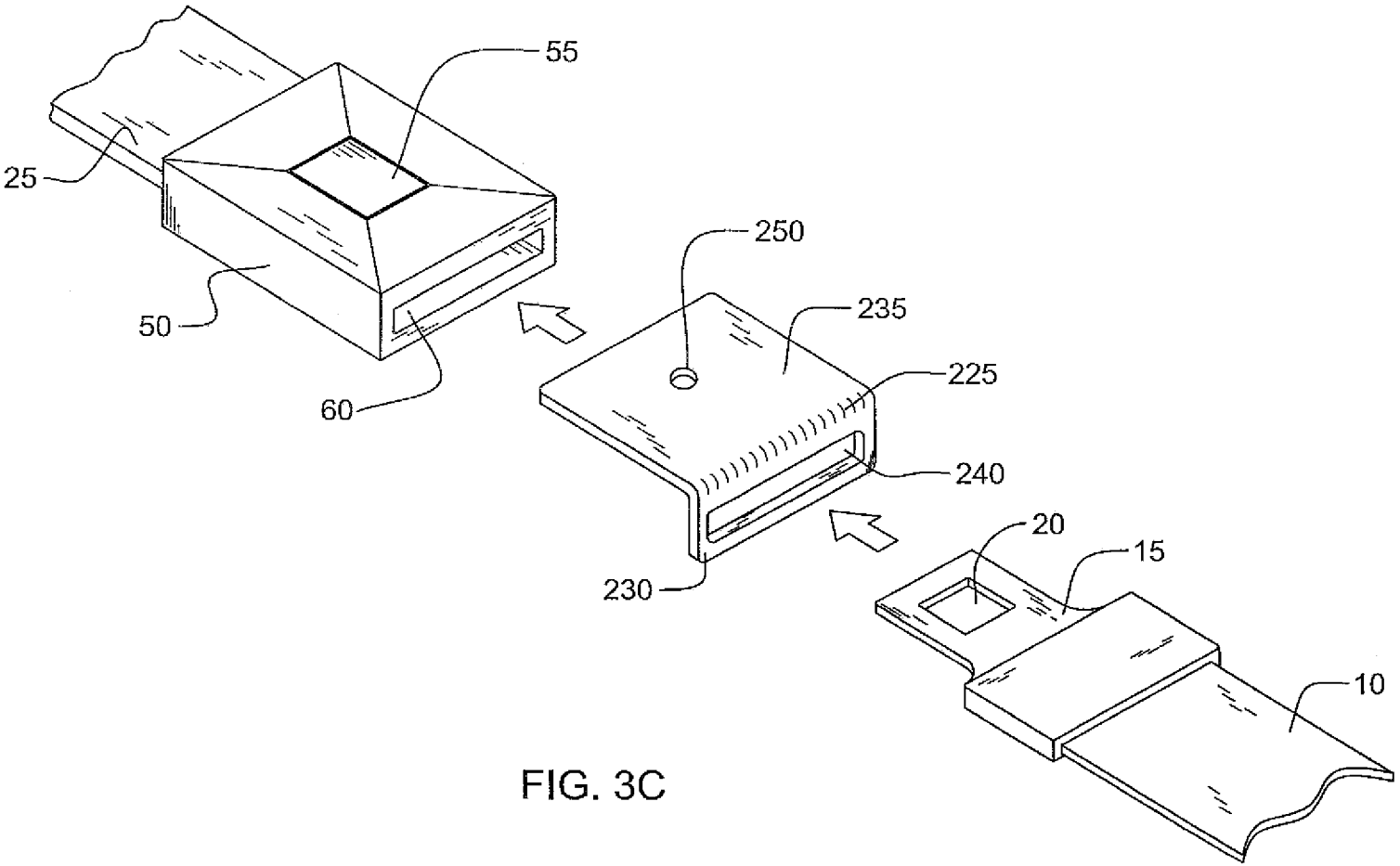
FIG. 3C is a perspective view of the seat belt safety device (200) of FIGS. 3A and 3B interposed between a seat belt tongue (15) and seat belt latch housing (30) in an exploded view to highlight device operation.

FIG. 3C depicts the operation of the seat belt safety device of FIGS. 3A, 3B. That is, the seat belt tongue (15) is inserted through the slot (240) in the first planar surface (230) from which the bend (225) turns, and then into the latch opening (60) in the locking mechanism housing (50). The orientation of the safety device (200) is such that the opening (250) is located proximate and above the push button release (55) and that an underside of the second planar surface (235) aligns with and contacts a planar or upper horizontal surface (52) of the buckle housing (50), as shown. When latched, there is very little leeway for movement of the safety device (200) off of the upper housing surface (52) and the underside of first planar surface (230) against the housing side with slot (60). This effectively prevents access (for example, by a finger) to the push button (55) other than by use of pressing means (155) extend through the access opening (250).

The above-described embodiments may be described as a seat belt safety device comprising a first substantially planar member with a pair of substantially parallel opposing edges along its length and a pair of substantially parallel opposing edges along its width; and a second substantially planar member attached and extending along one of the length-wise edges of the first planar member, and extending substantially perpendicularly a plane of the first planar member, wherein the first planar member includes a slot extending in parallel to the length-wise edge opposite the lengthwise edge to which the second planar member is attached and an opening, substantially centered, between the slot and the second planar member, for a latch housing with a side-located latch release button, or on the second substantially planar member for a latch housing with a seat belt latch release push button located on the top or exposed housing surface that is substantially perpendicular to the side with the housing slot.

Figure 4A:
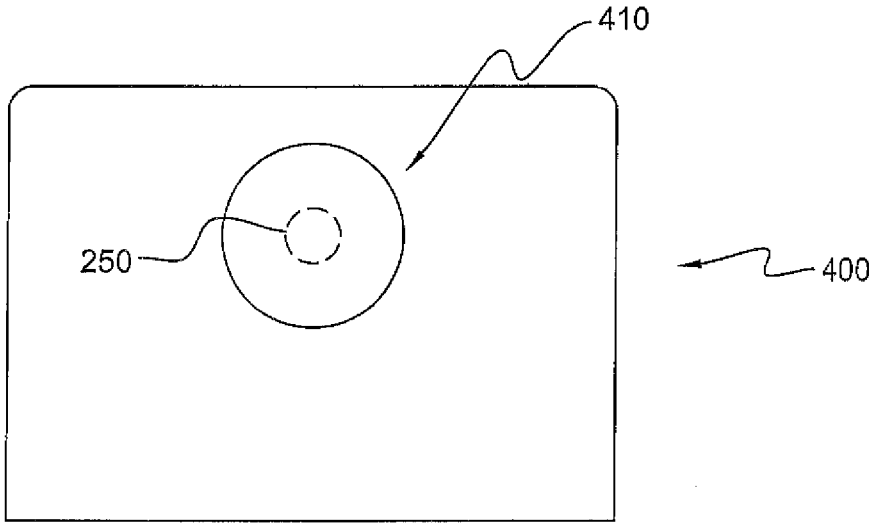
FIG. 4A is a top plan view of one embodiment of the seat belt safety device configured with a spring loaded release button actuator with arresting means limit operation by small children or cognitively challenged persons of a seat belt latch housing depicted in FIG. 1C.
Figure 4B:
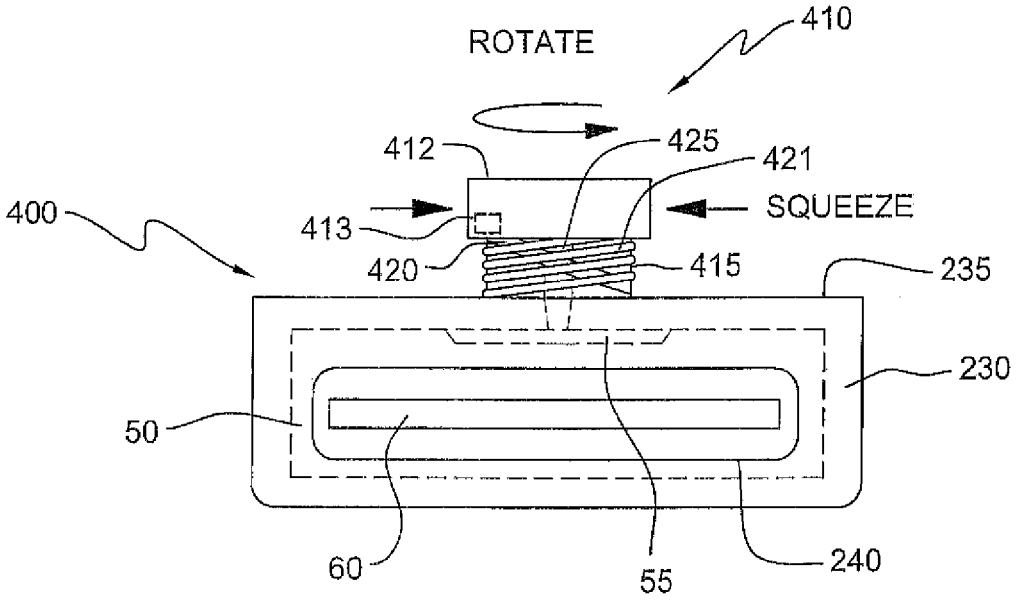
FIG. 4B is side plan view of the FIG. 4A embodiment.

FIGS. 4A and 4B together depict another embodiment of a seat belt safety device (400), which is quite similar in many respects to the embodiment of FIGS. 3A; 3B, but includes a spring loaded release button actuator (410) with arresting means provided under a gripping and pressing element (412), which limit seat belt release operation by small children or cognitively challenged persons of a seat belt latch housing depicted in FIG. 1B or 1C. That is, once the tongue element (15) is inserted through the opening (240) in the seat belt safety device (400) and then into latch opening (35, 60) of housings (30, 50), respectively, the release button actuator or pressing element (412) must be manipulated to enable depression and release or unlocking of the tongue (15) from a respective latch housing.

The gripping and pressing element (412) is arranged with one or more detent elements (413) on an inside circumferential surface that prevent the gripping and pressing element (412) from moving axially unless squeezed inwardly towards the radial center a certain radial amount (sometimes referred to as a "slip clutch" mechanism). Once sufficiently squeezed, the gripping and pressing element (412) is forced down as it rotates axially along path or track guide (420). Track (420) may be an indentation into a surface of cylindrical member (415), such as a groove, or may be an extrusion, such as a rail. The lock or detent element (413) present on the inside of the gripping and pressing element is allowed access to the track guide allowing downwards (and radial) movement only after squeezing to overcome the locked position in a groove track. As the detent element (413) moves axially down, a pushing member (425) extends through access opening (250) and makes contact, and actuates release button (55) in housing (50), or release button (40) in a side mounted housing (30). In a case where the guide track is a raised rail, the detent element is replaced by a grove that upon release from a locked state by squeezing, rides the rail as the pushing member advances vertically.

The gripping and pressing element (412) is spring actuated by use of a spring (421), so that when the pressure is removed, it moves (and rotates) upwards and back to its locked position. Spring (421) may comprise any common spring element sufficient to maintain gripping and pressing element (412) in the position depicted in FIG. 4B, and upon pressing and releasing, causes the gripping and pressing element (412) to move back into its "pre-pressed" position. If a user does not know how to operate the gripping and pressing element (412), in cooperation with the seat belt latch mechanism, they are unable to release or unlatch the seat belt. It should be noted that the particular means shown for preventing/allowing the pushing member (425) to contact and actuate the release button are for exemplary purposes only. Any means for locking/releasing the gripping and pressing element (412) that would act to hinder a child or mentally challenged person from readily pressing a release button to the skilled artisan, for example, a childproof pharmaceutical pill container, without deviating from the scope and spirit of the invention. Please further note that while the FIGS. 4A; 4B embodiment is shown arranged for use with a latch housing (50) configured with a top-positioned push button release (55), that the spring loaded release button actuator (410) may be implemented in a first planar section (130) of a seat belt safety device similar to the FIGS. 2A; 2B embodiment.

Figure 4C:
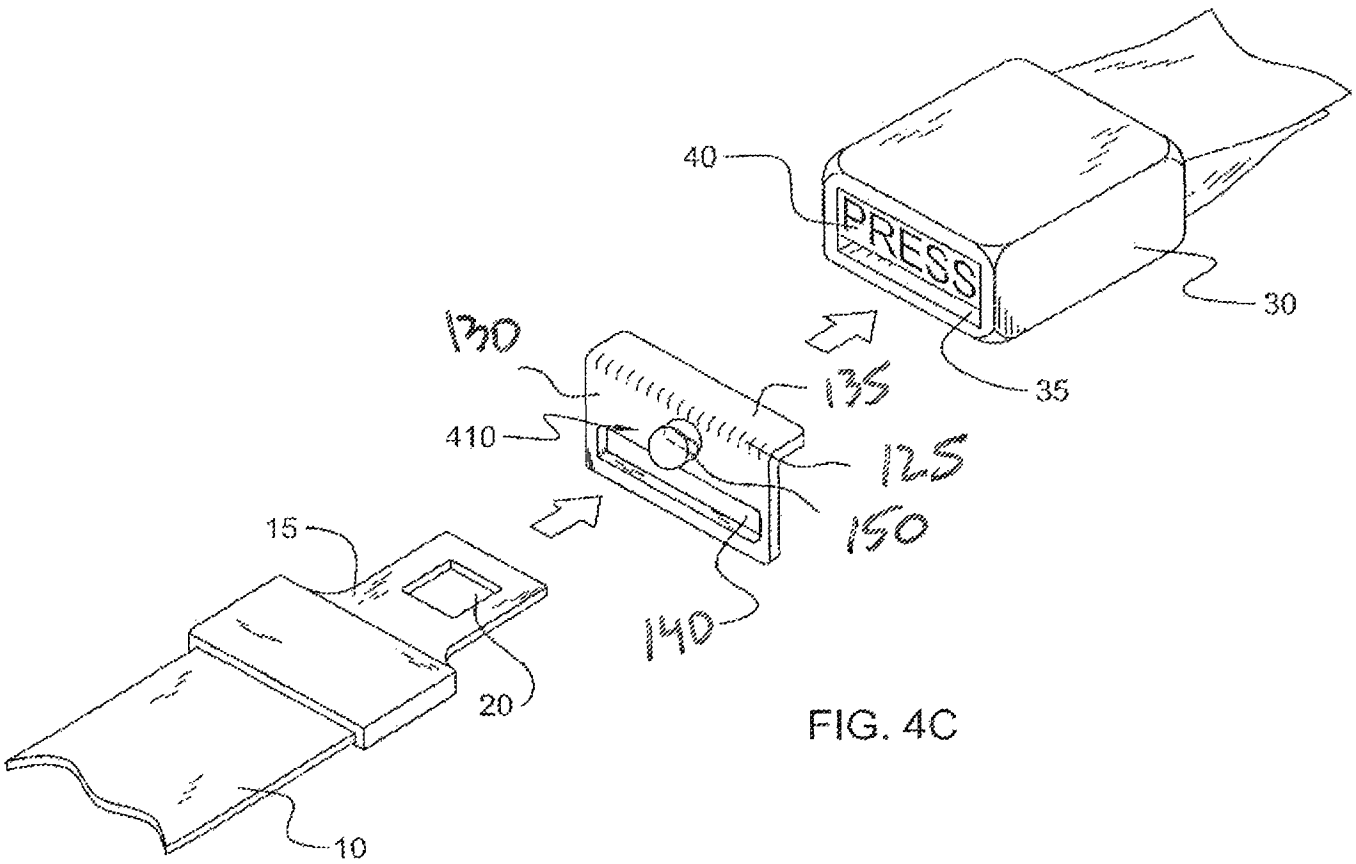
FIG. 4C is a perspective view of the a belt safety device (400) of FIGS. 4A and 4B interposed between a seat belt tongue (15) and seat belt latch housing (30) in an exploded view to highlight device operation.

FIG. 4C depicts the operation of the seat belt safety device of FIGS. 3A, 3B, modified such that the spring loaded release button actuator (410) is located on a side just above slot (140) so that tongue (15) may be inserted into an opening (35) of a housing (30). That is, the seat belt tongue (15) is inserted through the slot (140) in the first planar surface (130) from which the bend (125) turns, and then into the latch opening (35) in the locking mechanism housing (30). The orientation of the safety device (400) is such that the spring loaded release button actuator (410) is located proximate and above the push button release (40) and that an underside of the first planar surface (130) aligns with and contacts a planar or upper horizontal surface (32) of the buckle or latch housing (30), as shown. When latched, there is very little leeway for movement of the safety device (400) off of the upper housing surface (32) and the underside of first planar surface (130) against the housing side with slot (35). This effectively prevents access (for example, by a finger) to the push or press release button (40) other than by use of pressing means (425) extend through the access opening (150), as described.

Figure 5A:
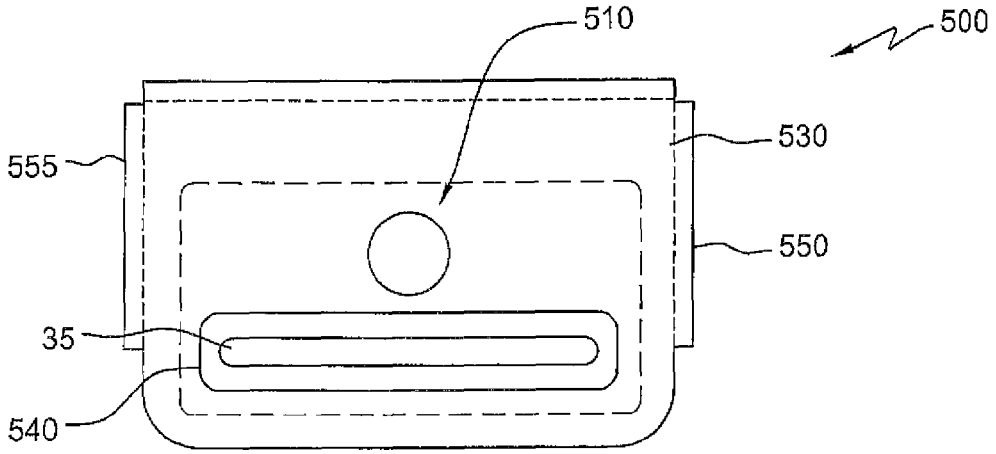
FIG. 5A depicts a front side view of another embodiment of the seat belt safety device of the invention for use with conventional seat belt locking mechanisms comprising side-button release.
Figure 5B:
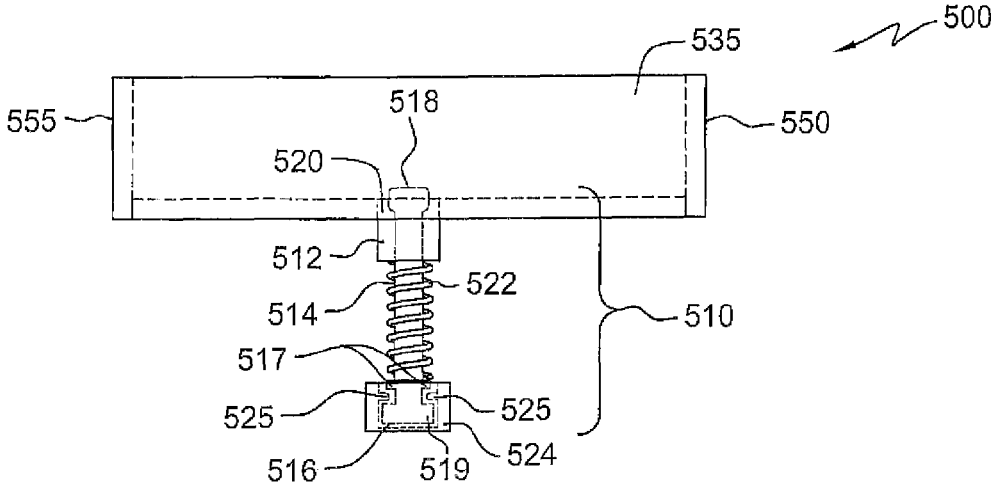
FIG. 5B depicts a top view of the FIG. 5A embodiment.
Figure 5C:
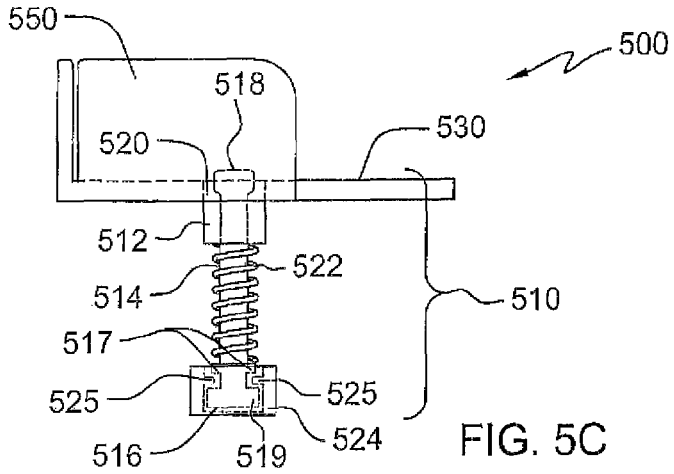
FIG. 5C depicts a left side view of the FIG. 5A embodiment.
Figure 5D:
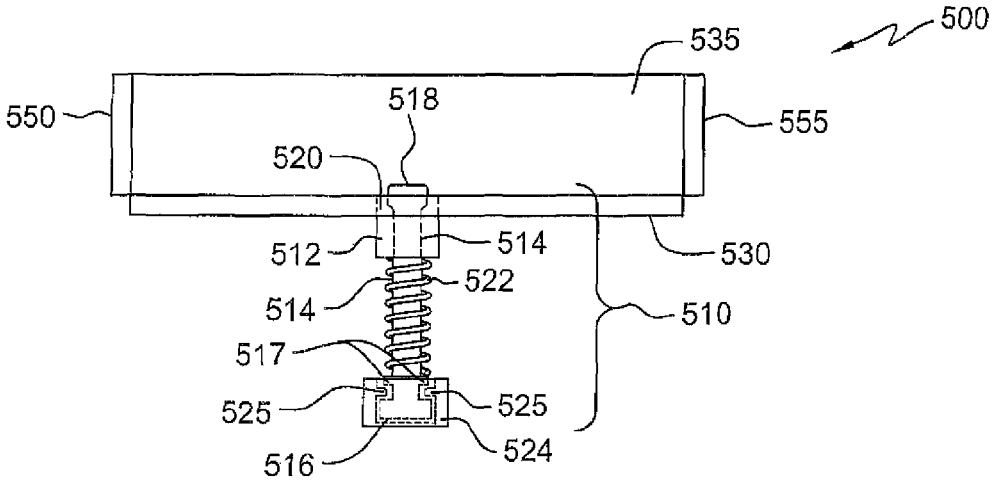
FIG. 5D depicts a bottom view of the FIG. 5A embodiment.
Figure 5E:
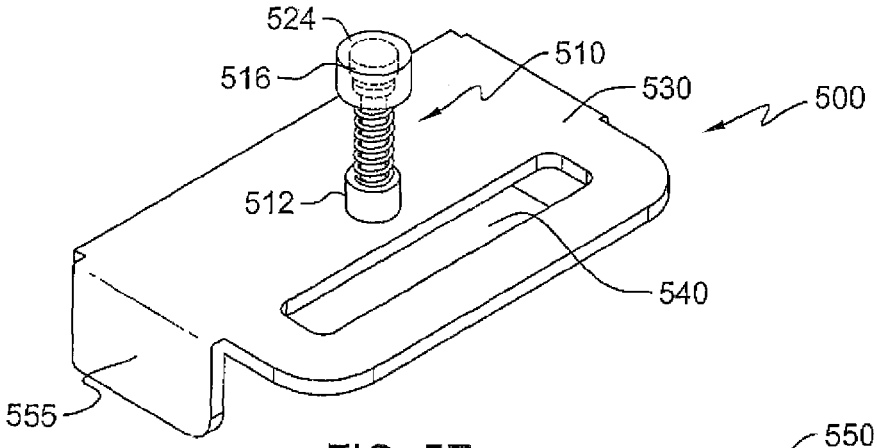
FIG. 5E depicts a top perspective view of the FIG. 5A embodiment.
Figure 5F:
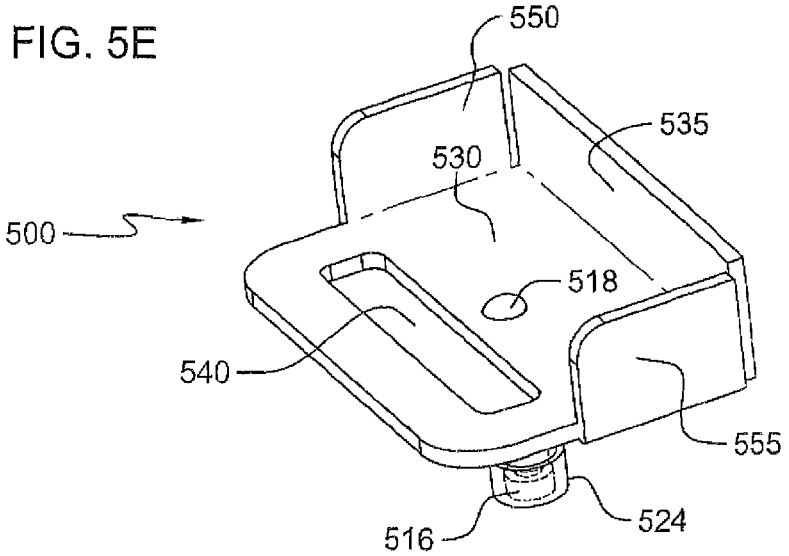
FIG. 5G depicts a bottom perspective view of the FIG. 5A embodiment.
FIG. 5H depicts an alternative embodiment to the seat belt safety device of FIGS. 5A-5G), configured for use with conventional seat belt locking mechanisms comprising top-button release.
Figure 5G:
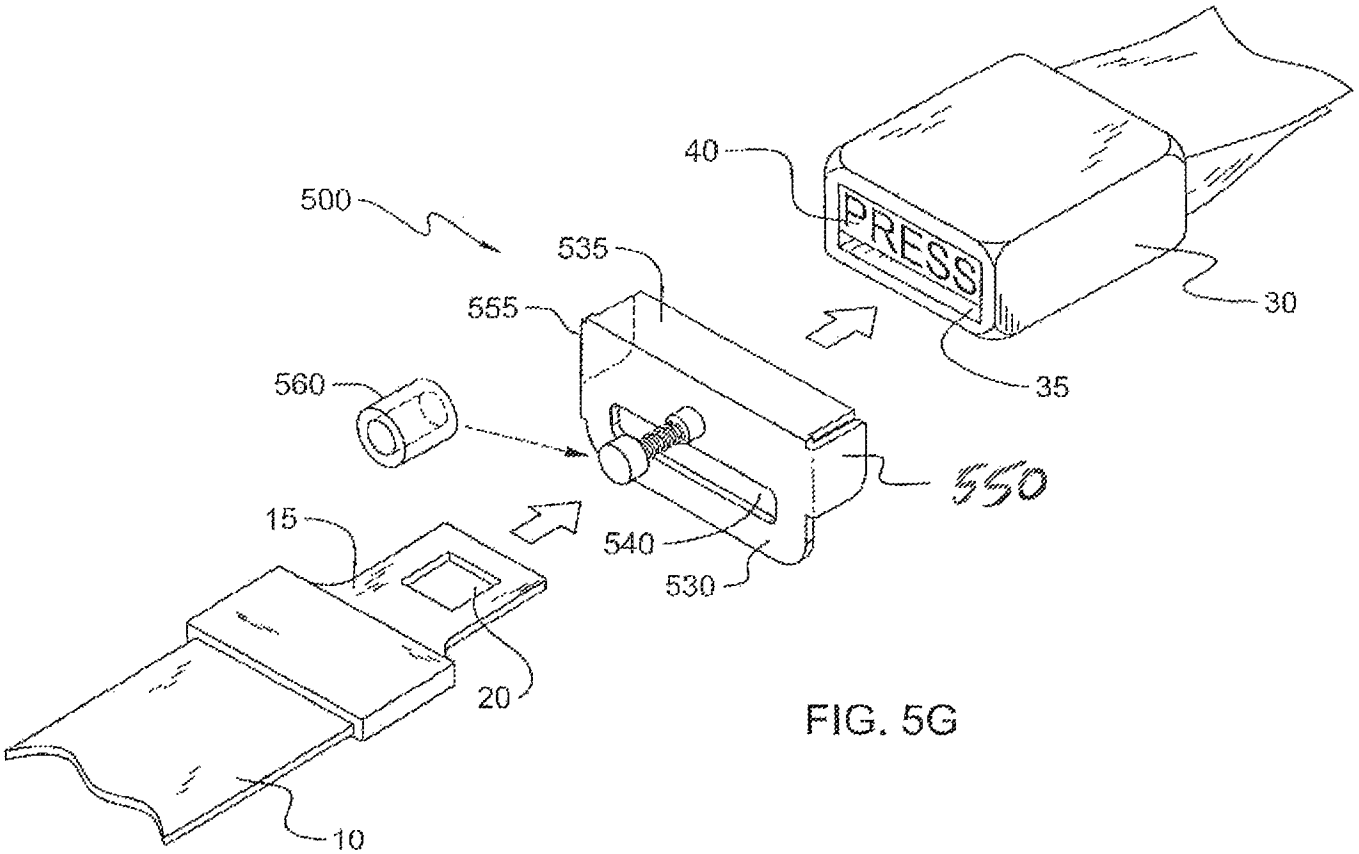
Figure 5H:
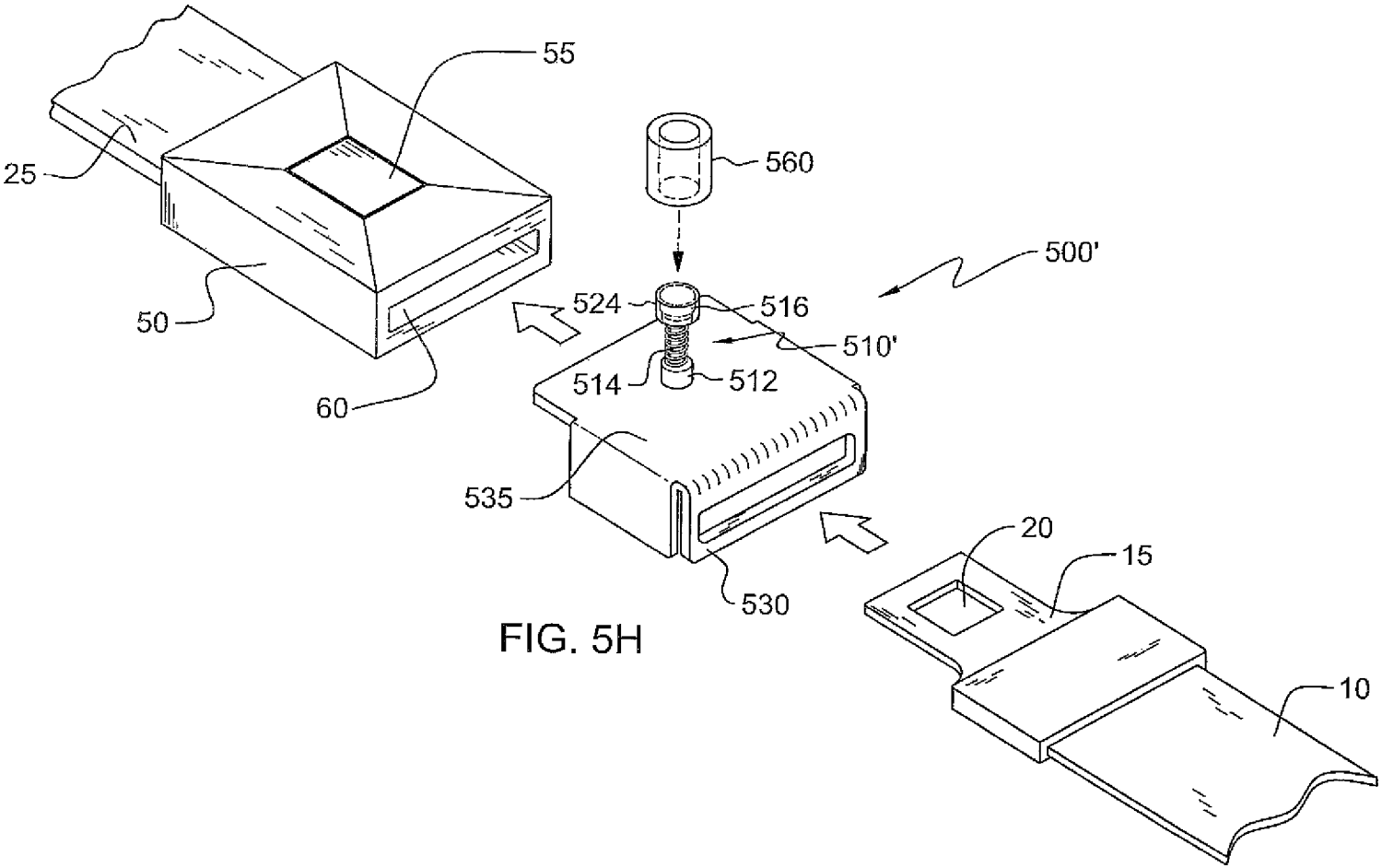

FIGS. 5A, 5B, 5C, 5D, 5E, 5F, 5G together depict another embodiment of a seat belt safety device (500) of the invention for use with conventional seat belt locking mechanisms comprising side-button release, where FIG. 5H depicts an like alternative embodiment seat belt safety device (500'), configured for use with conventional seat belt locking mechanisms comprising top-button release.

As shown in FIGS. 5A-5G, the seat belt safety device (500) is quite similar in many respects to the embodiments of FIGS. 3A-3B, 4A-4A, but includes significant structural and functional differences.

The seat belt safety device (500) is preferably formed from a sheet of metal to include a first substantially planar member (530), which is the side of the device in the embodiment shown, a second substantially planar member (535), which is the top of the device as shown and right (550) and left partial sides (555) as shown. The right and left partial sides (550, 555), together with the second planar member (335) form an open, partial enclosure about the housing (30), release button 40 and slot (35). While the first substantially planar member (530) may be rectangular, preferably same is formed with rounded edges at the bottom end, opposite the fold transitioning the first substantially planar member (530) to the second substantially planar member (535). The first substantially planar member (530) also includes a horizontal slot (540).

A blocking assembly (510) is attached to and extends substantially perpendicularly from the outer surface of the outer surface of the first substantially planar member (530). The blocking assembly (510) comprises a cylindrical standoff (512), welded to or otherwise affixed to the outer surface of the first substantially planar member (530). An inner channel or via extends the axial length of the cylindrical standoff (512), within which a moveable rod (514) is arranged to move axially to and fro. To one end of the moveable rod (514) is affixed or integral with a release handle (516). The other end of the moveable rod (514) is either connected to or integral with a blocking member (518), which has an outer radial dimension that is larger than an inner diameter of inner channel. Please note that an opening (520) through the first, substantially planar member (530) has a radius that is slightly greater than the radius of the blocking member (518). As such when the release handle is fully vertically extended away from the first planar member (530), the blocking member is seated (at the end of the rod (514)) against the end of the cylindrical standoff (512), preferably recessed in opening (520).

The lower portion of an inner cylindrical surface of the cylindrical blocking member (518) and a lower portion proximate the blocking member (518) are machined to allow the rod (514) and a gripping release handle (516) to turn on one rotational direction at least two (2) complete rotations to axial move to and lock the blocking member against the lower end of the cylindrical standoff (512) and, to turn in another rotational direction at least two (2) to move the blocking member (518) axially away from the lower end of the cylindrical standoff and first substantially planar member (530). When the gripping member (516) is turned to a locked position, the blocking member (518) is in a recessed position. When the gripping member is turned (at least two full rotations) from the locked position, to the unlocked position (before extending to actuate a seat belt release button), the blocking member (518) extends slightly beyond the inner surface of the first substantially planar member (530).

That is, once the blocking member (518) is moved away from the lower end of the cylindrical standoff by an axial distance in response at least two (2) turns, the rod (514) and blocking member are unlocked and, therefore, free to move axially (away from the planar surface) the remainder of the length of the rod (514) between the lower end of a gripping shoulder (519) of the release handle (516) and the upper cylindrical outer surface of the cylindrical standoff (512). This axial movement allows the blocking end (518) of the rod (514) to contact with and depress the actuator button (40) of the seat belt housing (30) and release the tongue (15) locked therein.

A spring (522) having on radius that is larger than the outer diameters of the rod (514), but smaller that an outer diameters of both the rod-connecting ends of both the release handle and the upper end of cylindrical standoff (512) surround the outer cylindrical surface of the rod (514). When the gripping shoulder (519) of handle (516) is gripped (i.e., engaged) and forced to extend axially past the surface of the first substantially planar member (530) to actuator button (40), the spring (522) is compressed. Energy stored in the compressed spring (522) is released upon a release of force by the user's hand, which compels the rod and handle to return to its axially extended state, but for the length attributable to the at least two turns. The handle (516) is then further returned the two (2) turns to set the handle (516) in the safety state when children or mentally challenged adolescents or adults are not able to operate the device to release the seat belt actuator button (40).

Preferable, each of the aforementioned elements are made of metal, most preferably stainless steel. The skilled artisan will not that the embodiment so design can be manipulated to release the seat belt if the seat-belt secured child or mentally challenged adolescents or adult figures out that the ability to release is contingent upon the at least two (2) completer rotations (preferably exactly two (2)). In order to further enhance the safety feature, the release handle (516) includes a radial groove formed between a slip shoulder (517) proximate the rod (512) and the gripping shoulder (519), within which a slip portion (525) of a flexible plastic handle (524) is slidingly and rotating arranged. The flexible plastic handle (524) operated as a slip clutch, as known to those with skill in the art and is squeezed in order to engage and rotate the gripping shoulder (519) of handle (516).

In a non-squeezed stated, the flexible plastic handle merely rotates about the handle (516), without engaging the handle (516), thereby preventing a rotational force of a user's hand from actually rotating the handle (516) and operating the seat belt release mechanism. That is, unless the flexible plastic handle (524) is sufficiently squeezed so that an inner cylindrical surface contacts and grips an outer cylindrical surface of gripping shoulder (519), the plastic handle (524) just spins and the handle (516) does not turn to allow the rod/blocking end (516/518) to extend. Preferably, the aforementioned contacting surfaces are conditioned to "hold" when contacted to facilitate gripping, e.g., the surfaces are scourged, grooved or cross-hatched.

FIG. 5H shows a seat belt safety device (500'), which is very similar to the embodiment depicted in FIGS. 5A-5G, other that the fact that the blocking assembly (510') of FIG. 5H is mounted on the second substantially planar surface (535), rather than the first substantially planar surface (530), and any further required dimensional modifications are made. Preferably, a flexible plastic, rubber, rubberized (preferably foam-like) "boot" (560) is positioned about the outer surface of cylindrical standoff (512) and spring 522, extending axially from the outer or upper surface of first planar member (530) up to the lower cylindrical surface of the release handle (516)/flexible plastic handle (524), where the rod connects to the release handle. The boot (560) keeps clothing, fingers, etc., from directly contacting the spring and possible interfering with its operation.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

What is claimed is:

1. A seat belt safety device for preventing access to a release button located on a surface of a seat belt housing attached to a first seat belt segment, the housing surface also including a housing opening through which a seat belt tongue attached to a second seat belt segment is inserted to securely latch the second seat belt segment to the seat belt housing and the first seat belt segment, the seat belt safety device comprising:

a metal sheet configured with a first substantially planar part, a second substantially planar part extending perpendicularly from a full bend at one end of the first substantially planar part, left and right substantially planar parts extending perpendicularly from bends at respective left and right ends of the first substantially planar part and a longitudinal slot extending for part of a distance between the left and right substantially planar parts substantially in parallel with a line of the full bend; and a blocking assembly comprising a cylindrical standoff extending perpendicularly from an outer surface of the first substantially planar part proximate the longitudinal slot and configured with an inner channel defined by a fixed radius and extending an entire axial length of the cylindrical standoff, a rod with a release handle at one end and a blocking member at its other end arranged for axial movement when the blocking assembly is not in a locked state and, a spring;

wherein the first substantially planar part includes a through-hole in communication with the inner channel of the cylindrical standoff, wherein the rod is formed with a channel portion moveably positioned within the inner channel and an extension portion extending between an end of the cylindrical standoff and the handle and which is surrounded by the spring, when the blocking assembly is in the locked state, wherein one end of the spring butts up against a disc-shaped surface of the cylindrical standoff and another end of the spring butts up against a lower cylindrical end of the handle and wherein applying a pushing force at the handle causes the channel portion and the blocking member to extend away from an inner surface of the first substantially planar part against a return force of the spring and, releasing the pushing force allows the spring to return the extended channel portion and the blocking member to a channel position, when the blocking assembly is in an unlocked state.

2. The seat belt safety device of claim 1, wherein the inner channel and the rod extension portion are configured to lock the blocking assembly to the locked state and unlock the blocking assembly from the locked state.

3. The seat belt safety device of claim 2, wherein an inner cylindrical surface of the inner channel and a portion of the rod extension portion proximate the blocking member are machined to allow the rod and the release handle to turn in one rotational direction at least two complete rotations to axially move to and lock the blocking member against a lower end of the cylindrical standoff and, to turn in another rotational direction at least two complete rotations to unlock and move the blocking member axially away from the lower end of the cylindrical standoff and first substantially planar part.

4. The seat belt safety device of claim 3, wherein upon moving the blocking member away from the lower end of the cylindrical standoff by an axial distance corresponding to at least two axial rotations, the rod and the blocking member are free to move axially the remainder of the length of the rod between the lower end of the release handle and the disc-shaped surface of the cylindrical standoff to contact with and depress the release button of the seat belt housing and release the tongue locked therein.

5. The seat belt safety device of claim 1, wherein a radial dimension of the blocking member is greater that a radial dimension of the inner channel.

6. The seat belt safety device of claim 1, wherein the blocking assembly is made of metal.

7. The seat belt safety device of claim 1, wherein the release handle includes a radial groove within which a slip portion of a flexible plastic handle is slidingly and rotating arranged.

8. The seat belt safety device of claim 7, wherein the flexible plastic handle operates as a slip clutch.

9. The seat belt safety device of claim 7, wherein the flexible plastic handle comprises a plastic shell that extends up from, the slip portion to envelop the release handle, including an inner shell surface proximate but not in contact with an outer gripping surface of the release handle.

10. The seat belt safety device of claim 9, wherein the flexible plastic handle is configured to be squeezed in order that the inner shell surface engages the outer gripping surface of the release handle to enable a user's hand to apply a rotating force to turn the release handle to a release position and operate the release button.

11. The seat belt safety device of claim 1, where the first and second substantially planar parts form an L shape.

12. The seat belt safety device of claim 11, wherein the right and left substantially planar parts extend for part of an entire width dimension of the first substantially planar.

13. The seat belt safety device of claim 12, wherein the first, second, right and left substantially planar parts form a partial enclosure covering the surface of the seat belt housing including the release button.

14. The seat belt safety device of claim 1, wherein a thickness or depth of the metal sheet is between 0.01 and 0.15 inches.

* * * * *